United States Patent [19]

Arima et al.

[11] Patent Number: 4,651,976

[45] Date of Patent: Mar. 24, 1987

[54] METHOD FOR OPERATING A CONVERTER USED FOR STEEL REFINING

[75] Inventors: Keizi Arima; Yujiro Ueda; Toru Yoshida; Hiroshi Narita, all of Sakai, Japan

[73] Assignee: Nippon Steel Corporation, Tokyo, Japan

[21] Appl. No.: 647,797

[22] Filed: Sep. 6, 1984

[30] Foreign Application Priority Data

Apr. 27, 1984 [JP] Japan ..... 59-84117

[51] Int. Cl.[4] ..... C21D 11/00

[52] U.S. Cl. ..... 266/44; 266/90; 266/100; 75/59.2

[58] Field of Search ..... 266/100, 90, 78, 225, 266/44, 81, 99, 94; 75/59.2, 59.1

[56] References Cited

U.S. PATENT DOCUMENTS 4,325,730 4/1982 Schleimer et al. ..... 266/78

FOREIGN PATENT DOCUMENTS

| | | | |
|---|---|---|---|
| 2514894 | 4/1983 | France | 266/99 |
| 52-101618 | 8/1977 | Japan . | |
| 54-33790 | 3/1979 | Japan . | |
| 54-114414 | 9/1979 | Japan . | |
| 55-104417 | 8/1980 | Japan . | |
| 57-140812 | 8/1982 | Japan . | |
| 58-48615 | 3/1983 | Japan . | |
| 0166612 | 9/1984 | Japan . | |

*Primary Examiner*—L. Dewayne Rutledge
*Assistant Examiner*—S. Kastler
*Attorney, Agent, or Firm*—Kenyon & Kenyon

[57] ABSTRACT

A method for operating a converter on the basis of a direct observation of the slag-forming conditions in a vessel interior.

A device for observing the vessel-interior light is disposed in a throughhole extending through the side wall of a top-blowing or top- and bottom-blowing converter to reach the vessel interior. The converter operation can be carried out at a high accuracy of the slag-amount control on the basis of this observation.

5 Claims, 29 Drawing Figures

METHOD FOR OPERATING A CONVERTER USED FOR STEEL REFINING

BACKGROUND OF THE INVENTION (1) Field of the Invention

The present invention relates to a method for operating a converter used for steel refining.

(2) Description of the Prior Art

In refining molten pig iron and steel in a converter, pure oxygen is ejected from a lance inserted through the mouth of the converter into the converter body (below "vessel"). The oxygen is blown onto the molten steel to both effect decarburization and stir the molten steel. In addition, flux is charged into the converter to slag the flux and hence to form molten slag, thereby effecting dephosphorization, desulfurization, or the like due to the reactions between the molten slag and steel.

Slag foaming occurs due to several slag conditions, such as the slag composition, viscosity,the total amount of oxygen in the slag, etc. Too extensive slag foaming causes the slag and even molten steel to overflow the converter mouth, which overflow is referred to as "slopping". Of course, the composition of the molten steel and the steel yield are greatly influenced by slopping. Also, various problems are caused, such as reduction in the operational efficiency and in th calorific content of the recovered gases, impairment of the operational environment, e.g., generation of brown smoke, and damage to the steelmaking devices. Slopping therefore must be suppressed as much as possible.

Various proposals have been made on how to enable prompt prediction of the slag conditions within a converter and hence realize optional converter operation without slopping.

Japanese Unexamined Patent Publication (Kokai) No. 52-101618 discloses a method for estimating the amount of slag by calculating the oxygen balance based on information on the waste gases during blowing and then estimating the amount of oxides formed in the converter, i.e., the molten slag. In this method, however, there is an unavoidable time delay due to the gas analysis and mathematical analysis. In addition, since slopping is not dependent upon just the amount of molten slag alone, the accuracy of prediction of slopping is not very high.

Various attempts have also been made on detecting the slag level by physical means. These include an acoustic measuring method (Japanese Unexamined Patent Publication No. 54-33790), a vibration measuring method (Japanese Unexamined Patent Publication No. 54-114,414), a method for measuring the inner pressure of a coverter (Japanese Unexamined Patent Publication No. 55-104,417), a method usig a microwave gauge (Japanese Unexamined Patent Publication No. 57-140812), and a method for measuring the surface temperature of the converter body (Japanese Unexamined Patent Publication No. 58-48615).

In the acoustic measuring method, changes in the frequency and magnitude of the acoustics generated in the converter are monitored to estimate the slag level and to predict slopping.

In the vibration measuring method, changes in the magnitude of lance vibration and the wave transition of the lance vibration are monitored during blowing to estimate the slag level or conditions and then to predict slopping.

In the method for measuring the inner pressure of a converter, variations in the ejecting pressure of the waste gases through the converter mouth are monitored to predict slopping.

In the method using a microwave gauge, a microwave is directly projected into the converter interior to directly measure the slag level based on the FM radar technique ad to predict slopping.

In the method for measuring the surface temperature of a converter body, the energy emission from the upper and lower parts of the converter body is detected as temperature, and the occurrence and magnitude of slopping are predicted based on the temperature magnitude and peak values.

The acoustic measuring method, vibration measuring method, method for measuring the inner pressure of a converter, and method for measuing the surface temperature of the converter body are all indirect measuring methods and suffer from low accuracies of prediction of slopping due to the inability to quantitatively measure the slag level or conditions. The method using a microwave gauge enables direct measurement of the slag level, but suffers from the fact that it is not easy to detect or estimate abnormalities by microwave measuremnt, since the melt, slag, gases, and the like effect consideraly complicated movement in the converter during blowing. In addition, this method requires sophisticated signal processing, which increases the cost of the measuring device.

Three of the present inventors studied the foaming behavior of slag and discovered that the light intensity and/or wave length of the gaseous atmosphere and the wavelength characteristics of light emitted from the gaseous atmosphere considerably differ from those of the slag. The above three inventors provided, in Japanese Patent Application No. 58-37872, a method for directly observing slag-forming conditions, i.e., the slag-foaming conditions, in a converter during blowing, characterized in that at least one observation device of the vessel-interior light is disposed in at least one throughhole of the side wall of a converter so as to face the vassel interior and observe the slag-forming conditions.

SUMMARY OF THE INVENTION

The present invention is a further development of the method disclosed in Japanese Patent Application No. 58-37872 and proposes a method realizing stable converter operation by means of increasing or decreasing the slag volume with the aid of the apparatus for observing the vessel-interior light disclosed in the Japanese patent application.

The present invention proposes a method for operating a top-blowing or top and bottom-blowing converter, wherein for observing the slag forming conditions in a vessel of a converter, at least one observation device of the vessel-interior light is disposed in at least one throughhole of a side wall of a converter facing the vessel interior, and, at least one of the following control operations is carried out in accordance with the observed slag-forming conditions: controlling a top-blowing oxygen rate; controlling lance height; charging auxiliary raw materials, and controlling a bottom-blowing gas rate.

DESCRIPTION OF THE PREFERRED EMBODIMENTS

Before discussing the preferred embodiments, a description will be given of the method for observing the vessel-interior light disclosed in Japanese Patent Application No. 58-37872 filed by the present assignee and invented by three of the present inventors.

Figure 1:
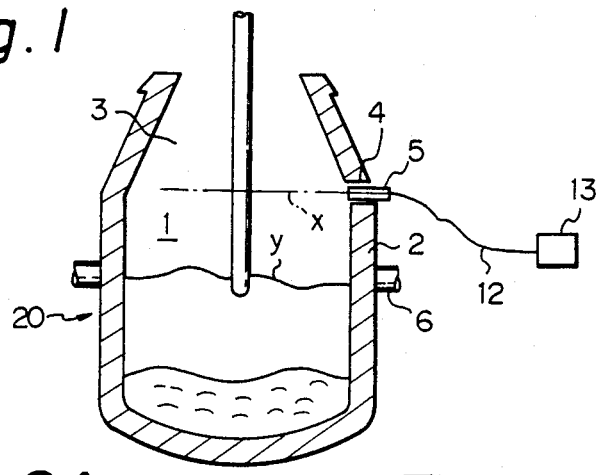
FIG. 1 is a cross-sectional view of a top-blowing converter, schematically showing a device for observing the vessel-interior light on the converter.

FIG. 1 is a cross-sectional view of a top-blowing converter, schematically showing an embodiment of mounting a device for observing the vessel-interior light. Referring to FIG. 1, a converter 1 is provided, on its side wall 2, with at least one throughhole 4 opening into the vessel interior 3. At least one vessel-interior observation device 5 is disposed in the throughhole 4 to face the vessel interior 3 and observe the intensity or the wavelength of the light emitted from the slag and gaseous atmosphere within the converter 1. This observation device 5 may be a photometer and is hereinafter referred to as the photometer 5. In FIG. 1, only one throughhole and observation device are shown.

It is possible, based on the measurement of intensity and/or wavelength of the light, to monitor whether the slag slopping occurs above or beneath a processing level X of the photometer 5.

Figure 2A:
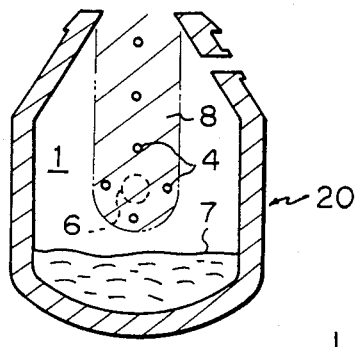
FIGS. 2A through 2C are cross-sectional views of a converter, showing non-immersion portions of the converter side wall.
Figure 2B:
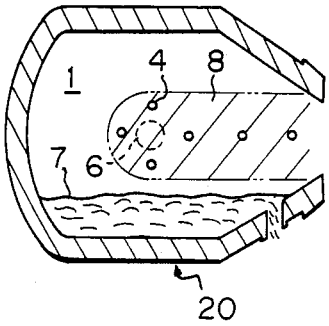
Figure 2C:
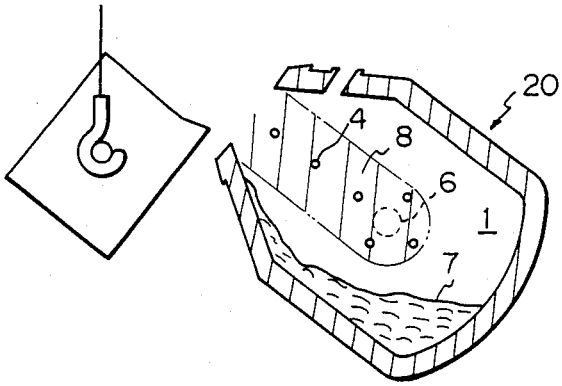

FIGS. 2A to 2C show non-immersion portions 8 of the converter side wall 2, i.e., in the converter upright position, tilting position for tapping, and tilting position for charging the pig iron from the ladle, respectively. In each of the positions shown in FIGS. 2A, 2B, and 2C, the portion of the converter wall 20 where a trunnion shaft 6 is rigidly secured and the region around that portion are not immersed within a melt 7. This portion and region, shown by the hatching, are the non-immersion portion 8. The throughholes 4 can be formed through the non-immersion portion 8 to prevent the melt 7 from entering the throughholes 4.

As is described below, the photometers 5 can also be removaly inserted into the tapping hole. When the molten steel is tapped through the tapping holes, hte photometers 5 are removed therefrom.

Figure 3A:
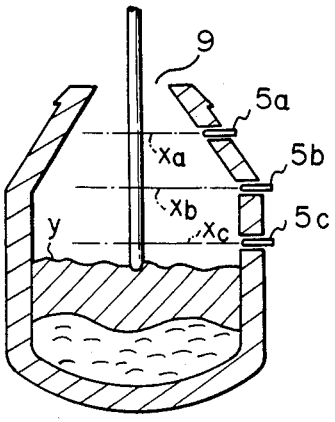
FIGS. 3A through 3C, FIG. 4, and FIG. 5 illustrate the principle of observing the vessel-interior light, FIGS. 3A through 3C showing the position of mounting the devices for observing vessel-interior light and FIGS. 4 and 5 showing time charts on the level of detected light signals.
Figure 3B:
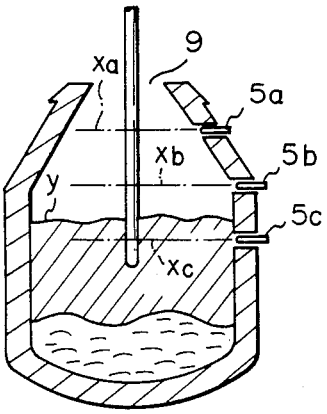
Figure 3C:
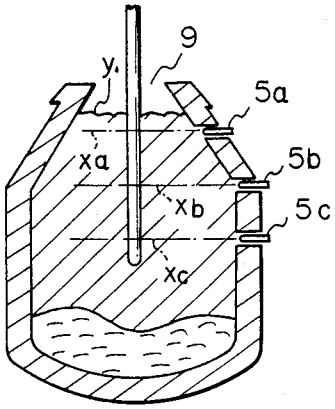

Referring to FIGS. 3A through 3C, three photometers 5*a*, 5*b*, and 5*c* are arranged as seen in the vertical direction of the converter, so as to measure the vesselinterior light at the levels Xa, Xb, and Xc, respectively. The position of the throughholes 4, i.e., their distance from the bottom or mouth of the converter 1, must be empirically determined by the size and capacity of the converter 1. In the case of single throughhole 4 the throughhole 4 must be located at the highest target slag level. In the case of plurality of throughholes 4, the highest and lowest throughholes 4 must be located straddling the highest target slag level.

Figure 4:
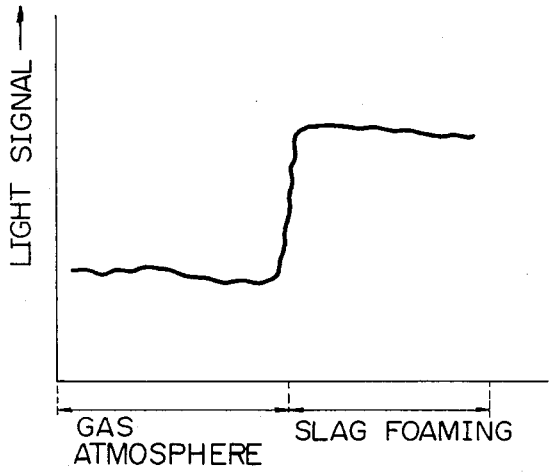

FIG. 4 shows the light signal (ordinate) detected by any one of the photometers 5*a*, 5*b*, and 5*c* and then subjected to signal processing with the aid of an appropriate filter. The abscissa of FIG. 4 indicates the blowing time periods, the former period when the gaseous atmosphere is present till beneath the level Xa, Xb, or Xc and the latter being when foaming slag is present beneath the levels Xa, Xb, or Xc.

Figure 5:
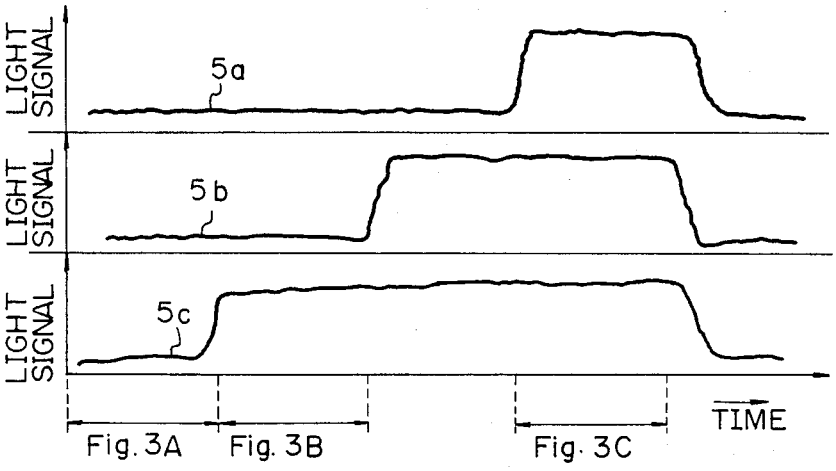

FIG. 5 illustrates the results of continuous measurement of the vessel-interior light by the photometers 5*a* through 5*c*. Under the slag-foaming conditions shown in FIG. 3A, all of the photometers 5*a* through 5*c* face or are exposed to the gaseous atmosphere, which indicates that the slag-foaming level y is located beneath the level Xc.

Under the slag-foaming conditions shown in FIG. 3B, the photometers 5*a* and 5*b* face or are exposed to the gaseous atmosphere and the photometer 5*c* faces or is exposed to the foaming slag. The slag-foaming level y is therefore located beneath the level of the converter mouth 9 and between the levels Xb and Xc.

Under the slag-foaming conditions shown in FIG. 3C, all of the photometers 5*a* through 5*c* face or are exposed to the slag. The slag-foaming level y is therefore located between the level of the converter mouth 9 and the level Xa of the photometer 5*a*.

The complicated foaming behavior of slag can therefore be accurately monitored by means of mounting a plurality of the photometers in the vertical direction and continuously measuring the vessel-interior light during the operation of the converter 1. If necessary, photometers may also be mounted along the width of the converter 1.

As described above, the intensity of light of the gaseous atmosphere and the wavelength characteristics of light emitted from the gaseous atmosphere considerably differ from those of the slag. Therefore, by direct observation of the vessel-interior light, it is possible to distinguish, without signal processing of the light, the light upon facing or exposure to the slag from the light upon facing or exposure to the gaseous atmosphere. However, if the vessel-interior light is subjected to signal processing with regard to the intensity or wavelength of the light, a clearer image of the slag-forming conditions can be obtained.

Using the slag-foaming behavior, one can preliminarily determine slag-forming criteria specifying the relationship between such behavior and slag-forming conditions. Therefore, it is possible to compare the detected intensity and/or wavelength of the vessel-interior light with the slag-forming criteria determined for specific slag-forming conditions.

The slag-forming criteria are determined for each converter having a specified structure and vessel volume and for each blowing conditions. The value detected by the photometers 5*a* through 5*c* (FIGS. 3A through 3C) is compared with the slag-forming criteria, thereby achieving detection of slag-forming conditions.

An example of the slag-forming criteria is as follows. When the slag-forming level y arrives at the level Xa of the highest photometer 5*a*, this means there is excessive slag formation and a high possibility of slopping. The level Xa can therefore be established as the slag-forming criterion indicating excessive formation of slag.

The slag-forming criteria are determined for each type of slag formation. That is, dephosphorization requires formation of a dephosphorizing slag having an appropriate total amount of iron oxide(s) for a normal dephosphorization reaction and also having a sufficient volume. The formaton of the dephosphorizing slag can be verified by monitoring the slag-forming level y, e.g., at the lowest level Xc of the photometer 5*c*. If the level of slag is beneath the lowest level Xc during the dephosphorizing period, abnormality in slag formation occurs.

Althrough the above explanation was made with reference to a plurality of photometers 5*a* through 5*c* arranged in the converter 1, it is possible to satisfactorily observe the slag-forming conditions even by a single photometer, as shown in FIG. 1 and as described hereinbelow.

Figure 6:
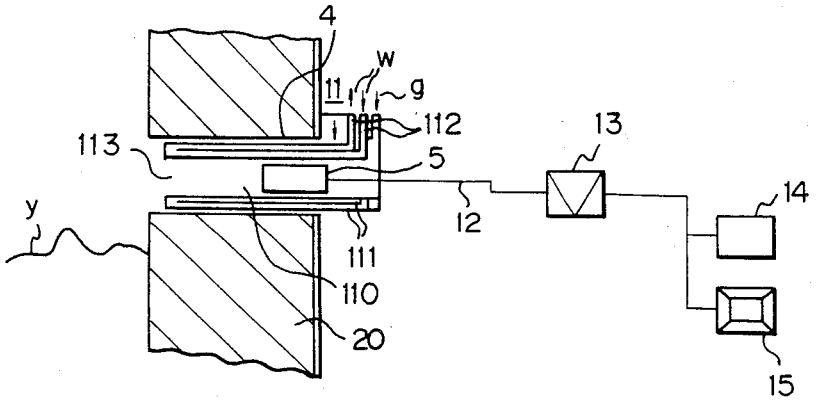
FIGS. 6 and 7 are partial cross-sectional views of a converter, showing different mounting structures of a device for observing the vessel-interior light.
Figure 7:
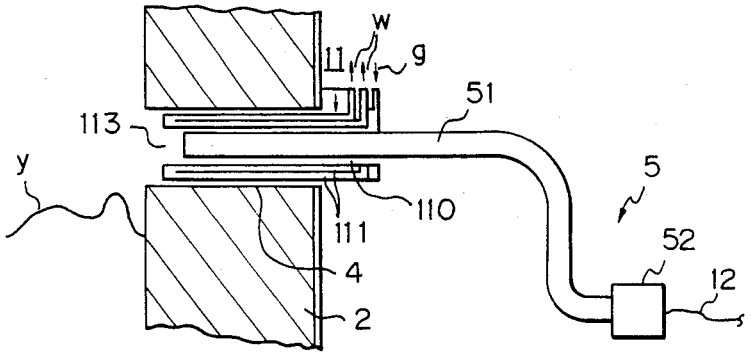

FIGS. 6 and 7 are partial cross-sectional views of a converter, showing different mounting structures of a photometer. Referring to FIG. 6, a photometer 5 is mounted in the throughhole 4 via a protective tube 11 having an inner cylinder 110. A cooling-water circulating channel 111 is formed in the protective tube 11. Cooling water w is supplied into the cooling-water circulating channel 111 via one of conduits 112. The water w is withdrawn via the other conduit 112. The photometer 5 is installed within the inner cylinder 110 in such a manner that its active side faces the vessel interior. Purge gas, such as $N_2$, Ar, $CO_2$, or another inert gas g, is supplied to and passed through the inner cylinder 110 and then ejected through the aperture 113 into the vessel. During its passage and ejection, the purge gas cools the photometer 5 and prevents gases including dust, slag, or the like from entering the inner cylinder 110.

The signal detected by the photometer 5 is input via a cable 12 into a signal processing device 13, such as a transmission filter, a computing device 14, and a display device 15.

The converter operation may be controlled either automatically or by a human operator. In automatic control, the signal detected by the photometer 5 is compared with the slag-forming criteria preliminarily input into the computing device 14 so as to automatically detect the slag-forming conditions. A warning signal or operating command is thereupon generated from the computing device 14 to various controlling devices (not shown). In control by a human operator, the operator watches detected values indicated on the display device 15 and compares them with predetermined slagforming criteria, to control the converter operation.

FIG. 7 shows anotehr example of the photometer in FIG. 7, the same reference numerals and symbols as those of FIG. 6 indicating identical members. An optical conductor 51, i.e., a body capable of transmitting at a low loss the light emitted from a high temperature body, e.g., a quartz-based optical fiber, is located in the inner cylinder 110 of the protective tube 11. The optical conductor 51 is connected to the body of a photometer 52, which is disposed at an appropriate position outside the converter. The structure shown in FIG. 7 is particularly advantageous, since the body of photometer 52, which is expensive, can be located a safe distance from the high-temperature wall 2.

The photometer 5 is not limited to any particular form provided that it can measure the intensity and/or wavelength of the vessel-interior light. The photometer 5 includes various assemblies; a MOS or CCD device assmbled with an optical filter, and a lens; a spectrometer and a photomultiplier; and an optical thermometer and a detector of the temperature profile.

Now, a discussion will be made of the method of converter operation according to the present invention.

In the method according to the present invention, the volume of slag is controlled on the basis of the detected slag-forming conditions so as to maintain the volume of slag within an appropriate range at a high accuracy. This method aims not only to predict the occurrence of slopping but also to enhance operational efficiency and improve the steel quality by means of observing the slag level at high accuracy, monitoring the variation tendencies in the slag level, and suppressing detrimental tendencies. A typical example of this embodiment is described with reference to FIG. 8.

Figure 8:
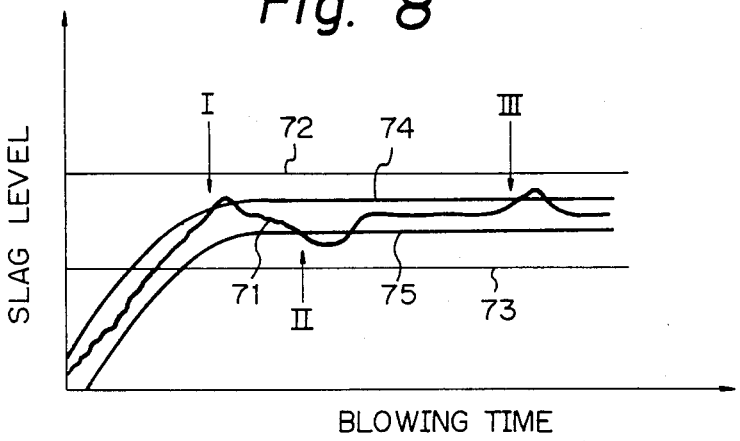
FIG. 8 illustrates the relationship between the slag level and blowing time.

Referring to FIG. 8, the level of slag at which slopping is likely to occur is denoted by 72. Reference numeral 74 indicates the change of the slag level with time, allowing one to maintain the level of slag lower than the level 72 over the entire blowing period. The level of slag at which the slag formation is poor is denoted by 73. Reference numeral 75 indicates the change of the slag level with time, allowing one to ensure, at a certain initial preparatory blowing period, a slag level higher than 75. In this example, target slag-level control is effected to control the level of slag between the levels 74 and 75 during the entire blowing period. The symbols I, II, and III indicate that slag-level control actions.

In an embodiment of the present invention, information is extracted from the signal obtained by the photometer so as to monitor the surface-area proportion of yellow base color to the entire color signal and variation in that proportion. The proportion and variation are compared with predetermined color criteria. This embodiment enables very accurate detection of the slag-forming conditions, as described with reference to FIG. 9.

Figure 9:
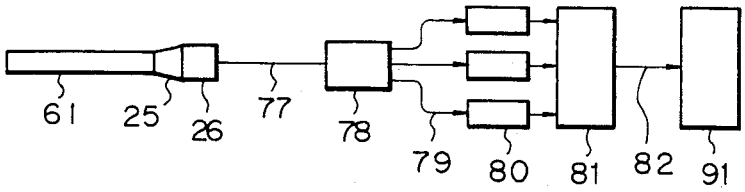
FIG. 9 is a block diagram of an example of the device for observing the vessel-interior light.

FIG. 9 is a block diagram for computing and outputting the proportion described above. A probe 61, more specifically a photoconductor, is provided with a connector 25 and photoelectric converter 26. The light detected by the probe 61 is electrically converted to an image signal 77 which is transmitted to a wavelength-range divider 78. Analog signals 79, i.e., one (B-blue) having a wavelength range of from approximately 0.3 to 0.4 μm, another (G-green) having a wavelength range of from approximately 0.4 to 0.6 μm, and the other (R-red) having a wavelength range of from approximately 0.6 to 0.8 μm, are generated by the wavelength range-divider 78. The analog signals are converted at an appropriate threshold level to binary signals 80 which are input into an area-computing device 81. In the area-computing device 81, the binary R signal, the binary G signal, and the binary B signal are multiplied by a count pulse of, for example, 0.134 μsec (7 MHz) in a reset cycle of 16.7 msec, and the number of pulses of R.G on and B off is counted. Thus, the area proportion of yellow base color is counted for each 16.7 msec cycle and is generated as the output signal of yellow 82, which is observed with an area-proportion display device 91.

Figure 10:
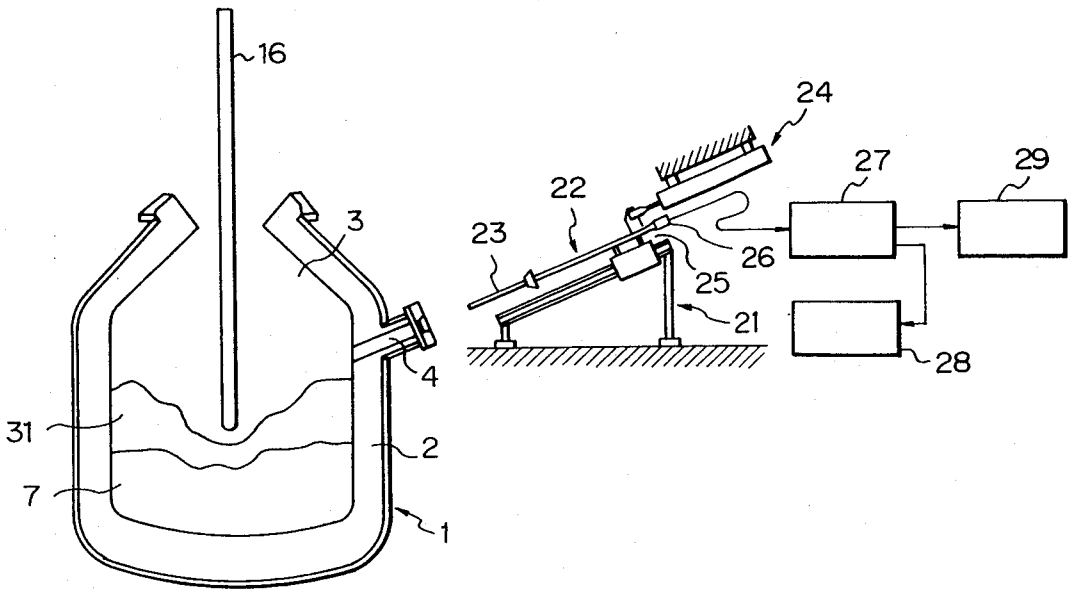
FIG. 10 is schematic drawing of the arrangement of the device for observing the vessel-interior light relative to the converter.
Figure 11:
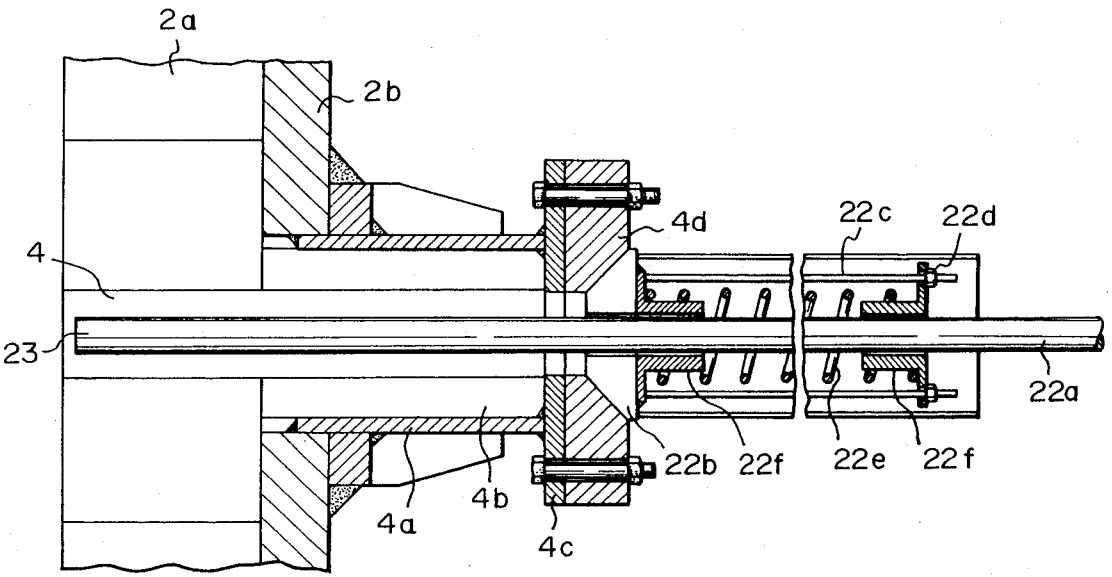
FIG. 11 is a partial cross-sectional view of a converter and a cross-sectional view of the device for observing the vessel-interior light, which device is gas-tightly inserted into a throughhole of the converter.

FIGS. 10, 11, and 12 show structure for mounting a photometer on a displacement mechanism disposed in the neighborhood of the converter and provided with means for retractably inserting the photometer into the throughhole.

Referring to FIG. 10, a supporting stand 21 located at the neighborhood of the converter 1 is equipped with a photometer 22. The photometer 22 includes an optical conductor and a receptor 23 at the front end thereof. The receptor 23 can be retractably advanced into the throughhole 4 by means of the displacement mechanism 24 which is secured to the supporting stand 21. The receptor 23 can therefore be timely inserted into the throughhole 4 when the vessel interior is to be observed and can be kept protected from such detrimental environments as thermal load and dusts during the operation period, e.g., the tapping period, in which the vessel interior is not to be observed. The tapping hole can therefore be utilized as the throughhole 4. The vessel-interior light received by the receptor 23 is transmitted via connector 25 into a photoelectric converter 26 for generating an electric signal. The electric signal is input into an image processor 27 for detecting the intensity and/or wavelength of the vessel-interior light. The detected signal is shown on a display 28 of the vessel-interior conditions or a display 29 of the slag level.

Referring to FIG. 11, showing a detailed structure of the photometer as well as an example of the seal mechanism of the throughhole 4, an inner brickwork lining 2*a* and steel mantle 2*b* have an aperture of, e.g., 500 mm diameter. A cylindrical body 4*a* has an inner refractory lining for defining the throughhole 4 and is welded to the steel mantle 2*b*. A flange 4*c* having an aperture is secured to the clyindrical body 4*a*. A seal cap 4*d* is attached to the flange 4*c* by bolts 4 and has a conical-shaped seal surface spread toward the vessel exterior. A probe 22*a* provided with a photoconductor therein (not shown) is equipped with a conical seal body 22*b*, the conical shape of which body allowing gastight cnotact with the seal cap 4*d*. The length of the probe tip end 23 is adjustable by an adjusting bar 22*c* an adjusting nut 22*d*, so that the probe tip end 23 can be positioned at an appropriate position to receive the vessel-interior light. The probe 22*a* is displaced toward and locked to the seal cap 4*d* by displacement mechanism 24 (FIG. 10). The spring 22*e*, which is guided along the spring guide 22*f*, is not indispensable but is preferable to further displace and thus compress the probe 22*a* against the seal cap 4*d*.

Figure 12A:
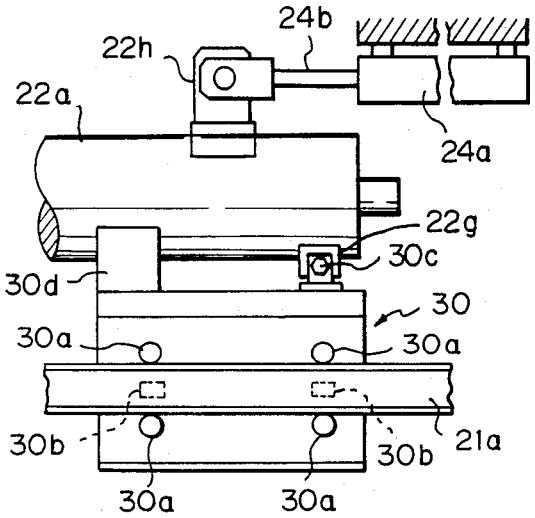
FIG. 12A is an overall view of a supporting platform with a displacement mechanism.
Figure 12B:
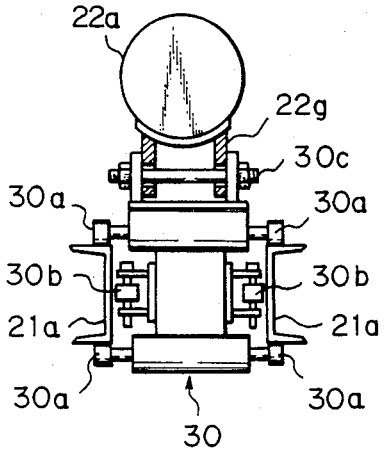
FIGS. 12B through 12E are partial views of the supporting platform shown in FIG. 12A.
Figure 12C:
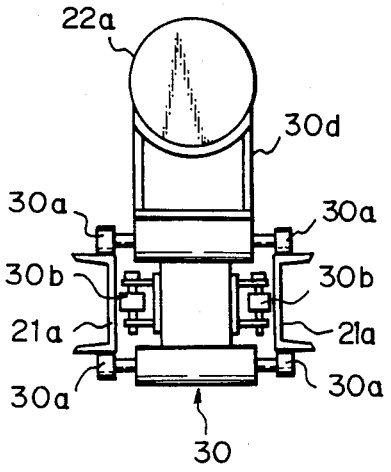

Referring to FIGS. 12A, 12B, and 12C, showing an example of the displacement mechanism 24, a supporting platform 30 having wheels 30*a* and 30*b* is displaced along a pair of rails 21*a*. The wheels 30*a* are attached to the supporting platform 30 so that they are engaged to the upper and lower surfaces of the rails 21*a*, while the wheels 30*b* are attached to the supporting platform 30 so that they are engaged to the inner surfaces of the rails 21*a*. The probe 22*a* is provided, at its rear end as seen from the throughhole (not shown), metallic fittings 22*q* and is loosely connected to the displacing platform via the metallic fittings 22*g* and a bolt 30*c*. The displacing platform 30*c* is provided with a probesupporting base 30*d* on which the probe 22*a* is freely placed.

The displacement mechanism 24 described above with reference to FIGS. 12A, 12B, and 12C, retractably displaces the receptor included in the probe tip end 23 into the throughhole 4 by means of carrying the displacing platform 30 along the rails 21*a*. The displacing platform 30 can be an automotive one directly equipped with a driving mechanism or one which is driven via a rod, gear, wire, or the like by means of an electric motor, pneumatic means, or hydraulic means installed separate from the displacing platform 30.

Figure 12D:
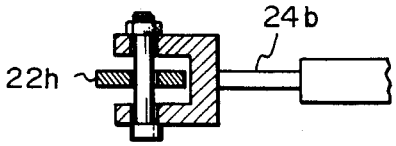
Figure 12E:
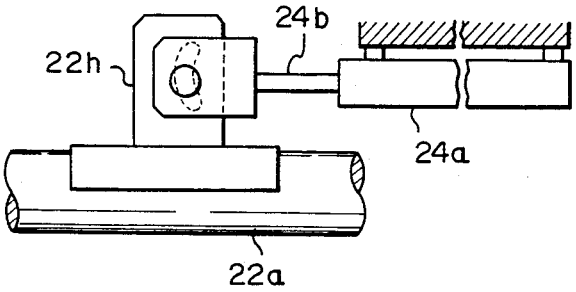

The driven mechanism shown in FIGS. 12A through 12C is hydraulic. The hydraulic cylinder 24*a* is connected via the rod 24*b* to the metallic fittings 22*h*, thereby transmitting the force of the hydraulic cylinder 24*a* to the probe 22*a*. As shown in FIGS. 12D and 12E, the metallic fitting 22*h* and the rod 24*b* are loosely connected with one another. Since the probe 22*a* is loosely connected to both the displacement mechanism 30 and the rod 24*b* as is described above and, further, since a clearance can be formed between the wheels 30*b* and one of the rails 21*a*, the probe 22*a* is somewhat displaceable in any direction, thereby making it possible to realize a further highly gas-tight contact between the conical seal body 22*b* and the conical seal surface of the seal cap 4*d*.

The probe 22*a*, including the photoconductor therein, is generally a dual tube, therefore, the annular space between the inner and outer tubes can be used as the passage for an inert gas blown toward the end of the probe so as to cool it or clean the receptor located at its end.

Figure 13:
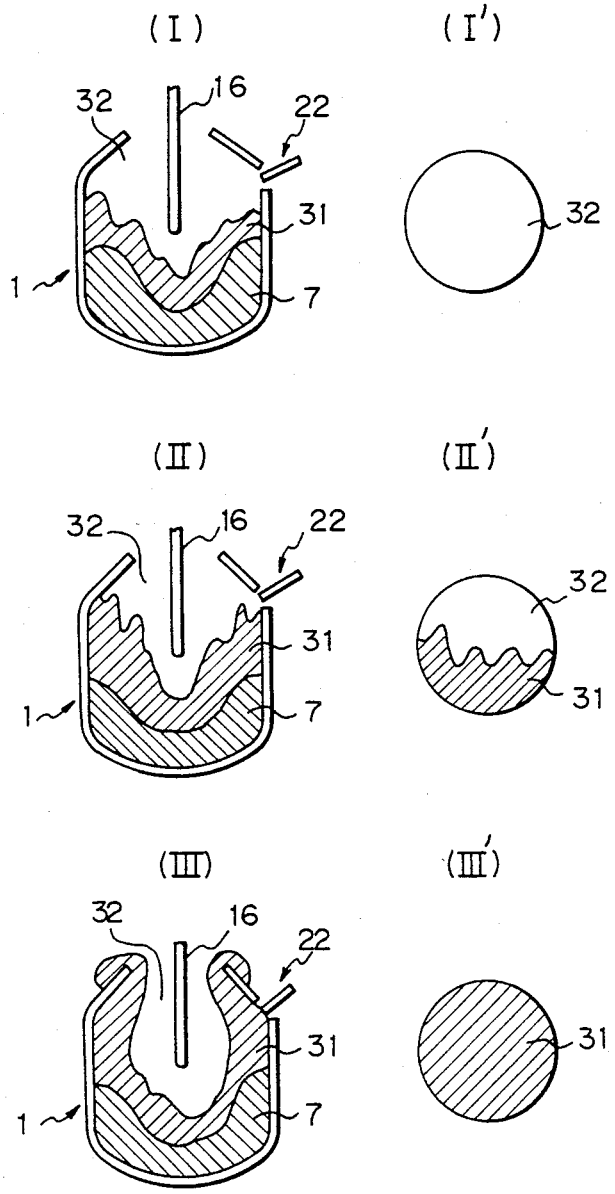
FIGS. 13 (I), (I'), (II), (II'), (III), and (III') illustrate the blowing conditions of a converter and the operation of the device for observing vessel-interior light according to the present invention.
Figure 14:
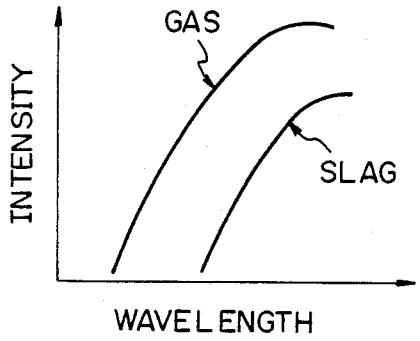
FIG. 14 graphically illustrates the relationship between the wavelength and intensity of light emitted from the slag and gaseous atmosphere above the slag.
Figure 15:
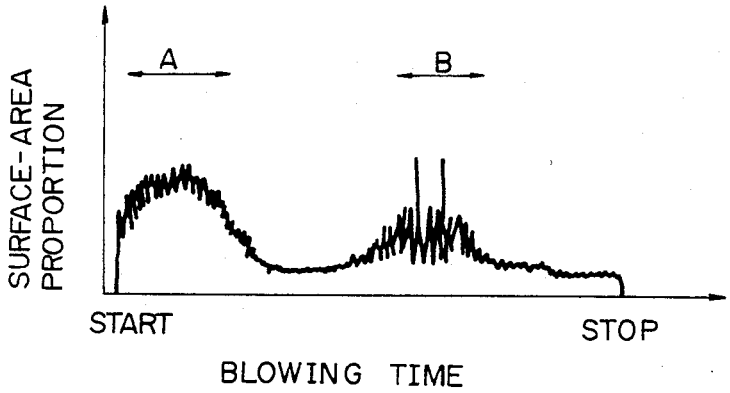
FIG. 15 illustrates an example of a vessel-interior display, showing the variation in the surface-area proportion with the lapse of blowing time.

Referring to FIGS. 13, 14, and 15, the photoelectrically conducted signal of the vessel-interior light is divided into a plurality of ranges of wavelength. The proportion of area of the light to the total image area of the receptor is computed with regard to each wavelength range, and the computed area proportion compared with predetermined slag-forming criteria.

Referring to FIGS. 13 (I, I') through (III, III') the melt 7 is charged in the converter 1. A photometer 22 is displaced until it is inserted into the throughhole. Oxygen begins to be blown through a lance 16, and then refining is initiated. The flux materials are charged into the converter 1 and form molten slag.

The amount of slag 31 is still relatively small in FIG. 13 (I), and the circular field of the receptor 22 gives a white image of the high-temperature gaseous atmosphere 32 of the converter, as shown in FIG. 13 (I'). When the slag formation further advances, the surface of the slag 31 (FIG. 13 (II)) is vigorously stirred by the oxygen blown through the lance 16 and by the CO gas or the like formed due to the blowing reactions. The slag 31, which is in an emulsion state and which has a lower temperature than the high-temperature gaseous atmosphere 32, is detected by the circular field of the receptor 22 as yellow waves. When the slag 31 (FIG. 13 (III)) overflows the converter mouth and slopping occurs, the circular field of the receptor 22 is entirely yellow. The above changes in the conditions of slag formation can be continuously observed by television with the naked eye or can be recorded as is explained with reference to FIGS. 14 and 15.

The intensity-wavelength relationship of slag becomes clearly different from that of the gaseous atmosphere above the slag, as shown in FIG. 14, when slag forming proceeds to an appreciable extent and the temperature of the gaseous atmosphere is higher than that of the slag. Therefore, the vessel-interior light can be subjected to wavelength separation by means of, for example, a blue-transmitting filter, so as to pass through the filter light having the wavelength range where the intensity of light emitted from the slag is dominant. The filtered light is subjected to a computing process so as to obtain the proportion of the filtered light to the entire area of the circular field of the receptor. The obtained surface-area proportion is plotted, as shown in FIG. 15, with time.

Referring to FIG. 15, A indicates the pseudo slag signal generated during the blowing start period, in which the temperature of the gaseous atmosphere is low, and B indicates an abrupt increase of the surface-area ratio and thus occurrence of slopping. Prior to the occurrence of slopping, the surface-area ratio intensely varies. The slopping can therefore be predicted on the basis of such intense change.

When a throughhole is exposed to the gaseous atmosphere, the vessel's contents progressively deposit on the throughhole, resulting in clogging. In an embodiment of the method of the present invention, described in with reference to FIGS. 16 and 17, observation of the vessel interior is carried out while blowing through the probe an oxygen-containing purge gas to prevent clogging of the throughhole. Clogging of throughhole is one of the most serious problems impeding the observation of the vessel interior. The situation is not so serious when using the tapping hole as the throughhole for observation. Since the tapping hole is brought into contact with molten steel at each tapping, the tapping hole can be maintained at an extremely high temperature even during the blowing period. The deposits on the tapping hole, composed of contents of the vessel, therefore cannot solidify that much and can be blown out even by inert purge gas blown through the probe tip end. Contrary to this, a throughhole formed at the non-immersing portion 8 (FIGS. 2A, 2B and 2C) cools due to non-contact with the molten steel and further cool if the inert purge gas is blown to it through the probe tip end. Still, deposits on the throughhole can be melted due to the latent heat of the slag when the end of the throughhole is exposed to the foaming slag. In this case, the deposits can be blown out by inert purge gas, thus preventing accumulation of deposits.

Oxygen-containing purge gas is the preferred purge gas discovered after various investigations of the assignee of the present application. In this regard, while the coolant gas of the probe can be blown at an almost constant rate to attain the intended cooling, the flow rate of the oxygen-containing purge gas for attaining the intended purge greatly varies depending upon the position of the throughhole, quality and quantity of the vessel's content, temperature, and vessel interior conditions. Control of the flow-rate for the purge is therefore difficult. It is more desirable and convenient to control and to vary the oxygen content of the purge gas.

Figure 16:
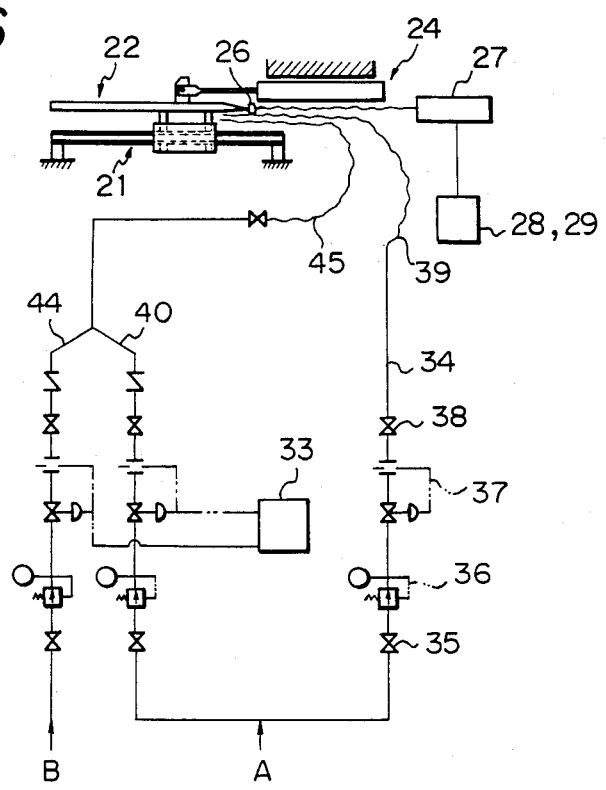
FIG. 16 illustrates an example of the piping of purge gas.
Figure 17:
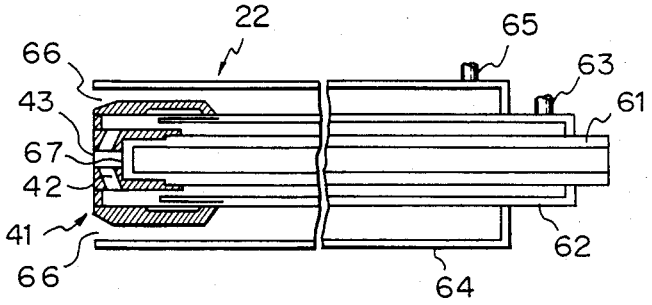
FIG. 17 is a partial cross-sectional view of an example of a probe according to the present invention.

Referring to FIG. 16, inert gas is fed from a source A and is separately blown into conduit systems 34 and 40. The conduit system 34 includes a stop valve 35 and a reducing valve 36, a flow-rate adjusting device 37 with an orifice and flow-control valve, and a stop valve 38 successively arranged in the flow direction. The inert gas blown through the conduit system 34 flows via a flexible hose 39 into an inner cylinder 62 (FIG. 17) which is connected via an inlet port 63 (FIG. 17) to the flexible hose 39. The inert gas is further blown through a small aperture 42 of a front tip 41 screwed into a probe 61. The inert gas is then released from a tip aperture 43 into the vessel interior while preventing fogging or contamination of a front glass 67 of the probe 61.

The inert gas flowing through the conduit system 40 is mixed with oxygen fed from a source B into the conduit system 44. The mixture gas flows via a flexible hose 45 and inlet port 65 into an outer cylinder 64 to cool the outer surface of the inner cylinder 62 and the front tip 41. The mixture gas is released into the vessel interior from the outer cylinder 64. The flow rate ratio of oxygen to inert gas is adjusted by a flow-rate controller 33 connected to the conduit systems 40 and 44. The reverse L ( ) symbol indicates the check valves located upstream of the joining point of the conduit systems 40 and 44. The probe 61 includes a photoconductor therein. The symbols 26, 27, 28, and 29 indicate a photoelectric converter, image processor, display device of the vessel-interior condition, and slag level-display device, respectively.

The invention will be further clarified by the ensuing examples, which, however, by no means limit the invention.

EXAMPLE 1

A 170 ton top- and bottom-blowing converter 8 m in height was charged with melt 1.5 m in depth. A throughhole was formed at the converter wall 2.5 m perpendicularly under the mouth. An optical fiber 12 mm in diameter was used as a photoconductor and inserted into a cooling protective tube. A CCD color-camera was used as a photoelectric converter. The slag level was detected by the method as described with reference to FIG. 9 of computing the area ratio of yellow base color. The relationship between the area ratio of yellow base color and the position of the optical fiber was so established that the area ratio was 50% when the slag level coincided at the center of field of the optical fiber. The area ratio 100% and 0% corresponded to the slag levels above and below the throughhole, respectively. The threshold levels in the binary circuit were R 35%, G 35%, and B 25%.

Figure 18:
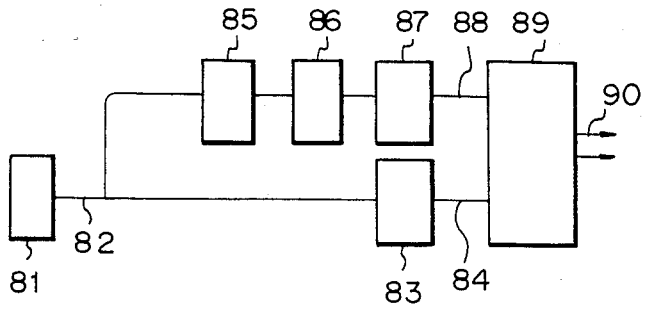
FIG. 18 is a block diagram of method of detecting the slag-forming conditions.

Slopping was detected by the following method, described in reference to FIG. 18. The area ratio signal of yellow base color 82 from a circuit 81 was divided and transmitted into two circuits. In one of the circuits, the area ratio signal was converted in the binary circuit 83 having appropriate threshold level (10%), into a binary signal 84. In the other circuit, the area-ratio signal of yellow base color 82 was passed through a high-pass filter 85 (cut frequency of 5 Hz) and then converted to a positive value at a circuit 86. The positive signal was converted to a binary signal 88 in the binary circuit 87 having an appropriate threshold level (50%), which binary signal 88 indicated the changes in the area ratio. The two binary signals 84 and 88 were input into a decision circuit 89. The possibility of occurrence of slopping was decided as shown in Table 1.

TABLE 1

| Possibility of occurrence of slopping | Yes | No | No | No |
|---|---|---|---|---|
| Binary signal 84 (Area ratio of yellow base color) | 1 | 1 | 0 | 0 |
| Binary signal 88 (Change in the area ratio of yellow base color) | 1 | 0 | 1 | 0 |

The control actions to attain the target slag level were as shown in Table 2.

TABLE 2

| | Operating object | Controlling method or amount: Suppression of foaming | Controlling method or amount: Promotion of foaming |
|---|---|---|---|
| No. 1 | Bottom-blowing flow rate ($CO_2$) | Increase by 50 $Nm^3/H$ | Decrease by 50 $Nm^3/H$ |
| No. 2 | Lance height | Decrease by 100 mm | Increase by 100 mm |
| No. 3 | Top blowing flowing rate | Increase by 1000 $Nm^3/H$ | Decrease by 1000 $Nm^3/H$ |
| No. 4 | Auxiliary raw materials | Continuous charging of coolant | Charging of agent (fluorite) to promote slag formation |

Figure 19:
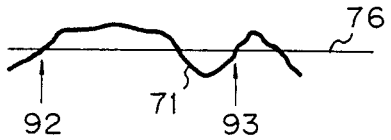
FIGS. 19 through 21 illustrate the slag level during blowing and a method for controlling it.

One or more of the operating objects were manipulated as described with reference to FIGS. 19 through 21. Referring to FIG. 19, when the slag level varies during operation as shown by a curve 71 and exceeds the target slag level 76 at the points 92 and 93 and when there is no possibility of occurrence of slopping, an increase in the bottom-blowing flow rate (No. 1) is effective to attain the target slag level 76.

Figure 20:
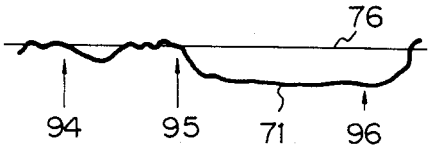

Referring to FIG. 20, when the slag level varies during operation as shown by the curve 71 and falls under the target slag level 76 at the points 94 and 95, a decrease in the bottom-blowing flow rate (No. 1) is first employed. If the slag level seemingly will not reach the target level 76 approximately 2 minutes after than the decrease in bottom-blowing flow rate, the lance is lifted (No. 2) or the oxygen-flow rate is decreased (No. 3) to promoto the foaming of slag.

Figure 21:
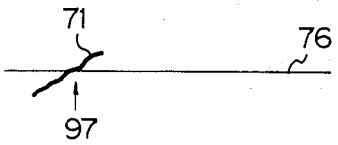

Referring to FIG. 21, when the slag level varies during operation as shown by the curve 71 and exceeds the target slag level 76 at the point 97 and when there is a possibility of occurrence of slopping, continuous addition of ore and dolomite is effective to attain the target slag level 76 and to prevent slopping.

It was found that the operations are preferably carried out in the order of Nos. 1, 2, 3, and 4. It was also found that, for action I in FIG. 8, increasing the bottom blowing rate was effective and, for action II, either decreasing the bottom blowing rate or lifting the lance (increasing the lance height) was effective.

The operations as described above were carried out for 50 heats. The results are shown in Table 3.

TABLE 3

| | (T—Fe) % $\bar{X}$ | (T—Fe) % $\sigma$ | [P] ($\times 10^{-3}$ %) at blowing end $\bar{X}$ | [P] ($\times 10^{-3}$ %) at blowing end $\sigma$ | Blown heats with slopping (%) | Failure in [P] outside standard (%) | Remarks |
|---|---|---|---|---|---|---|---|
| Invention | 15 | 1.1 | 20 | 2.2 | 2 | 0.5 | Low-carbon steel |
| Conventional | 16 | 2.3 | 17 | 5.3 | 28 | 4.2 | [P] $\leqq 25 \times 10^{-3}$ % |

What is claimed is:

1. A method for operating a top-blowing or top and bottom-blowing converter comprising:

providing a converter vessel holding a molten iron base metal;

providing at least one observation device of vessel interior light disposed in at least one throughhole of a side wall of said vessel, with said observation device facing the interior of said vessel;

detecting vessel interior light caused by said molten metal with said observation device;

determining slag-forming conditions prior to slopping of the slag by analysis of said detected vessel interior light; and selectively carrying out at least one of the following control operations responsive to said determined slag-forming conditions: controlling a top-blowing oxygen rate, controlling lance height, charging auxiliary raw materials, and controlling bottom-flowing gas rate.

2. A method according to claim 1, wherein the intensity and/or wavelength of the vessel-interior light is detected by said at least one observation device and said at least one observation device has a receptor for receiving the vessel-interior light and facing the vessel interior.

3. A method according to claim 2, wherein said at least one observation device is included in a respective probe and the observation is carried out while blowing through the probe an oxygen-containing purge gas to prevent clogging of the at least one throughhole due to deposit of contents of the vessel.

4. A method according to claim 2, wherein said at least one observation device is mounted on a respective displacement mechanism disposed in neighborhood of the converter and provided with a means for retractably inserting the observation device into said at least one throughhole.

5. A method according to claim 4 wherein said observation device is a photometer.

* * * * *

UNITED STATES PATENT AND TRADEMARK OFFICE

CERTIFICATE OF CORRECTION

PATENT NO. : 4,651,976

DATED : March 24, 1987

INVENTOR(S) : K. Arima, et al.

It is certified that error appears in the above-identified patent and that said Letters Patent is hereby corrected as shown below:

Column 1, line 28, change "in th calorific" to --in the calorific--.

Column 1, line 35, change "optional" to --optimal--.

Column 1, line 55, change "usig" to --using--.

Column 2, line 8, change "ad" to --and--.

Column 2, line 27, change "remnt" to --rement--.

Column 2, line 28, change "consideraly" to --considerably--.

Column 2, line 40, change "slag-foaming" to --slag-forming--.

Column 2, line 45, change "vassel" to -vessel- -.

Column 4, line 21, change "removaly" to --removably--.

Column 4, line 22, change "hte" to --the--.

UNITED STATES PATENT AND TRADEMARK OFFICE

CERTIFICATE OF CORRECTION

PATENT NO. : 4,651,976

DATED : March 24, 1987

INVENTOR(S) : K. Arima, et al.

It is certified that error appears in the above-identified patent and that said Letters Patent is hereby corrected as shown below:

Column 4, line 26, change "vesselin-" to --vessel in---.

Column 5, line 22, change "conditions." to --condition.--.

Column 6, line 13, change "slagforming" to --slag-forming--.

Column 6, line 15, change "anotehr" to --another--.

Column 6, line 61, change "that" to --the--.

Column 7, line 22, change "R.G" to --R·G--.

Column 7, line 65, change "gastight" to --gas-tight-- and "cnotact" to --contact--.

Column 8, line 17, change "22q" to --22g--.

Column 8, line 20, change "probesupporting" to --probe-supporting--.

UNITED STATES PATENT AND TRADEMARK OFFICE

CERTIFICATE OF CORRECTION

PATENT NO. : 4,651,976

DATED : March 24, 1987

INVENTOR(S) : K. Arima, et al.

It is certified that error appears in the above-identified patent and that said Letters Patent is hereby corrected as shown below:

Column 9, line 6, change "an emulsion" to --a molten--.

Column 9, line 43, change "in" to --herein--.

Column 9, line 59, change "cool" to --cools--.

Column 10, line 33, change "L ( )" to -- Z ( Z )--.

Column 11, line 52, change "after than the" to --after the--.

Column 11, line 55, change "promoto" to --promote--.

Column 12, line 40, change "flowing" to --blowing--.

Signed and Sealed this

Sixth Day of October, 1987

*Attest:*

*Attesting Officer*

DONALD J. QUIGG

*Commissioner of Patents and Trademarks*